US006881272B2

(12) United States Patent
Black et al.

(10) Patent No.: US 6,881,272 B2
(45) Date of Patent: Apr. 19, 2005

(54) SELECTIVE REMOVAL OF PHOTORECEPTOR COATINGS BY ULTRASONIFICATION

(75) Inventors: David G. Black, Longmont, CO (US); Weimei Luo Gheleta, Louisville, CO (US); Ronald H. Levin, Lafayette, CO (US); Dat Q. Nguyen, Flatteville, KY (US)

(73) Assignee: Lexmark International, Inc., Lexington, KY (US)

( * ) Notice: Subject to any disclaimer, the term of this patent is extended or adjusted under 35 U.S.C. 154(b) by 496 days.

(21) Appl. No.: 10/164,676

(22) Filed: Jun. 6, 2002

(65) Prior Publication Data

US 2003/0230321 A1 Dec. 18, 2003

(51) Int. Cl.[7] ..... B08B 3/12
(52) U.S. Cl. ..... 134/1; 134/38; 134/40
(58) Field of Search ..... 134/1, 38, 40, 134/19, 26, 30, 34; 427/534, 336, 271, 273

(56) References Cited

U.S. PATENT DOCUMENTS

| | | | | |
|---|---|---|---|---|
| 4,858,264 A | | 8/1989 | Reinhart | 15/93 R |
| 5,170,683 A | | 12/1992 | Kawada et al. | 82/1.11 |
| 5,240,506 A | | 8/1993 | Liers et al. | 134/1 |
| 5,403,627 A | | 4/1995 | Wilbert et al. | 427/554 |
| 5,437,729 A | | 8/1995 | Boatner et al. | 134/1 |
| 5,723,422 A | | 3/1998 | O'Dell et al. | 510/166 |
| 5,746,836 A | | 5/1998 | Fukai | 134/1 |
| 5,858,106 A | | 1/1999 | Ohmi et al. | 134/1 |
| 6,569,587 B1 | * | 5/2003 | Sasaki et al. | 430/78 |

FOREIGN PATENT DOCUMENTS

JP 04344650 A * 12/1992 ..... G03G/5/05

OTHER PUBLICATIONS

Japanese Application 11295908 (Chem. Abs. 131:315812) & Abstract.
Japanese Application 10239869 (Chem. Abs. 129:267854) & Abstract.
Japanese Application 09211875 (Chem. Abs. 127:212493) & Abstract.
Japanese Application 09179326 (Chem. Abs. 127:169041) Abstract Only.
Japanese Application 10213911 (Chem. Abs. 129:209296) & Abstract.
Japanese Application 08146623 (Chem. Abs. 125:181239) & Abstract.

* cited by examiner

*Primary Examiner*—Alexander Markoff
(74) *Attorney, Agent, or Firm*—John A. Brady

(57) ABSTRACT

A method for recycling photoconductors is disclosed. In this method, the charge transport layer is selectively removed from the photoconductor without adversely affecting the electrical properties of the charge generating layer. The recycled drum may then be recoated with a new charge transport layer and reused in an electrophotographic process. In this method, the photoconductor to be recycled is placed in a specifically selected solvent, such as a dibasic ester, and is subjected to ultrasonic energy, preferably for a period not to exceed about 15 minutes.

27 Claims, No Drawings

SELECTIVE REMOVAL OF PHOTORECEPTOR COATINGS BY ULTRASONIFICATION

TECHNICAL FIELD

The present invention relates to electrophotography and particularly to a process for recycling electrophotographic drums (photoconductors/photoreceptors).

BACKGROUND OF THE INVENTION

In electrophotography, a latent image is created on the surface of an insulating photoconducting material by selectively exposing an area of this surface to light. A difference in electrostatic charge density is created between the areas on the surface exposed and unexposed to the light. The latent electrostatic image is developed into a visible image by electrostatic toners containing pigment components and thermoplastic components. The toners, which may be liquids or powders, are selectively attracted to the photoconductor surface, either exposed or unexposed to light, depending upon the relative electrostatic charge on the photoconductor surface and the toner. The photoconductor may be either positively or negatively charged, and the toner system similarly may contain negatively or positively charged particles.

A sheet of paper or intermediate transfer medium is given an electrostatic charge opposite that of the toner and is then passed close the photoconductor surface, pulling the toner from that surface onto the paper or the transfer medium still in the pattern of the image developed from the photoconductor surface. A set of fuser rolls melts and fixes the toner on the paper, subsequent to direct transfer (or indirect transfer where an intermediate transfer medium is used), producing the printed image.

Metal cores, often made from aluminum alloys, are typically used as substrates for organic photoconductors. They provide mechanical stability and serve as a base upon which the various functional layers may be coated, deposited or otherwise created. These aluminum cores are often anodized or coated with a subbing layer to provide adequate electrical stability and defect control in the final product. In most commercial, organic photoconductors, a charge generation layer (CGL) is coated upon this processed core. This layer is needed for light absorption and exciton creation. A charge transport layer (CTL) is typically coated over the CGL. This layer plays a role in exciton separation and charge transport. Typically, it is only the outer-most CTL that becomes worn or damaged during photoconductor use in a printer or copier. Therefore, if the CTL could be selectively removed and the remaining processed core and organic layers could be reintroduced into the photoreceptor coating process at the CTL-coating step, then a considerable savings in material cost and process time could be achieved. Significant environmental advantages would also attend such a process.

The potential importance of photoconductor recycling is best demonstrated by the number of patents that presently exist in this area. These patents generally teach the removal of all layers of the photoconductor down to the metal core; there is no selective removal of a specific layer. The majority of such photoconductor recycling techniques use abrasive methods to remove the various layers: brushes (see, for example, JP 11295908; Chem. Abs. 131: 315812), blasting polishing slurries (see, for example, JP 10239869; Chem. Abs. 129:267854), wiping (see, for example, JP 09211875; Chem. Abs. 127:212493), and jetted streams (see, for example, JP 09179326; Chem. Abs. 127:169041), are all known for use for this purpose. These methods suffer from a lack of selectivity in that all layers are removed down to the native metal core. Another method used for layer removal involves immersion of the photoconductor into a solvent system, wherein the organic layers swell and eventually dissolve away. This is a slow, time-consuming, non-selective process, and special or noxious chemicals must typically be added to accelerate the removal process (see, for example, JP 10213911, Chem. Abs. 129: 209296; and JP 08146623,Chem. Abs. 125: 181239). Harsh chemicals, such as strong acids, not only non-selectively remove all organic coatings, but also potentially damage or remove the anodization layer. Examples of such prior art processes follow.

U.S. Pat. No. 5,858,106, Ohmi, et al., issued Jan. 12, 1999, describes a method for removing organic films from semiconductors at room temperature. The key is that the films are peeled off rather than being dissolved which damages the semiconductor surface. In this process, the surface to be cleaned is placed in a solution comprising a mixture of organic solvents, such as isopropanol, water, and halogenated alkali salts (such a potassium chloride or potassium fluoride), and ultrasonic energy is applied.

U.S. Pat. No. 5,746,836, Fukai, issued May 5, 1998, describes a method for removing all photosensitive layers from a drum utilizing a mixture of water and a solvent (such as dimethyl succinate), and applying ultrasonic energy for a period of twenty minutes or more. The process removes all layers of the electrophotographic coating, not just the charge transport layer selectively.

U.S. Pat. No. 5,437,729, Boatner, et al., issued Aug. 1, 1995, describes a method for removing the top layer of a ceramic surface selectively by implanting ions into the surface at selected depths and locations, placing the surface in a liquid medium (such as water, isopropanol, butanol, hexane, or ether), and applying ultrasonic energy to the liquid medium. The use of this process on photoreceptors is not disclosed or suggested.

U.S. Pat. No. 5,403,627, Wilbert, et al., issued Apr. 4, 1995, describes a method for removing all layers of photoreceptor coating but only on a portion of the photoconductive drum. This is accomplished by directing a high intensity energy source (such as a laser, ultrasonic source, or heat) to a portion of the drum and using a gas or liquid jet to help remove the coating. The ultrasonic energy is applied through a liquid/solvent bath (such as methylene chloride and/or trichloroethylene).

U.S. Pat. No. 4,858,264, Reinhart, issued Aug. 22, 1989, describes a method for removing coatings (for example, protective coatings from aircraft) without requiring the use of solvents. The process uses mechanical energy of a reciprocating or vibratory nature to achieve the coating removal without damaging the underlying metal substrate.

U.S. Pat. No. 5,723,422, O'Dell, et al., issued Mar. 3, 1998, describes a process for cleaning photoreceptor substrates (for example, the removal of petroleum-based cutting oils) prior to applying the photosensitive layers. The cleaning solution utilized comprises a weak acid, borax or a polyphosphonate, an oil-soluble surfactant, and a water-soluble surfactant (such as polysorbate or a polyethylene/polypropylene copolymer). Ultrasonic energy may be applied to the part submersed in the cleaning solution.

U.S. Pat. No. 5,170,683, Kawada, et al., issued Dec. 15, 1992, describes a method for surface processing a drum used to make a photoconductor prior to application of the photosensitive layers. In this process, the surface of an aluminum roll is machined using a sintered polycrystal diamond with water as the cutting liquid. The photosensitive layers are applied after the drum surface has been treated.

U.S. Pat. No. 5,240,506, Liers, et al., issued Aug. 31, 1993, describes a method for cleaning ink residues from the surface of an engraved printing cylinder. In this process, the printing cylinder is rotated in a detergent solution while ultrasonic energy is applied to it.

U.S. Pat. No. 4,007,982, Stange, issued Feb. 15, 1977, describes a blade system for cleaning particulate matter off an electrophotographic imaging member during its use. The blade is vibrated parallel to the imaging surface using a high frequency vibration.

The challenge to achieving a selective CTL removal process is that it must be a process which would remove the CTL completely, while leaving other photoreceptor layers unharmed and undisturbed. Furthermore, since the population of used photoreceptor drums that would be introduced into the recycling process would, by its nature, include a wide range of CTL thicknesses, a varied binary removal process, i.e., one that in the time required to remove a thick CTL does not alter any other layers on a drum with a thin CTL, is necessary. For example, as the CTL is removed, the CGL cannot be removed or swollen, nor can the CGL components be extracted. Additionally, at least a portion of the electrical fatigue that builds up in a cycled photoreceptor has been thought to originate from processes occurring in the CGL. Hence, even if a process for selective removal of the CTL could be defined, it was not at all clear from the prior art that an electrically useful photoconductor could be produced just by recoating a new CTL. Surprisingly, we have found that upon placing a new or used photoreceptor drum (i.e., drums spanning the range of CTL thicknesses) into an ultrasonic bath containing certain specifically-defined solvents, the CTL coating may be quickly, easily and selectively removed, without damaging any of the other photoconductive coatings on the drum. Further, the electrical properties of reprocessed drums match those of drums that have passed through the photoconductor coating process just one time.

SUMMARY OF THE INVENTION

The present invention relates to a method for selectively removing the charge transport layer from a photosensitive drum without damaging the charge generating layer on said drum, comprising the steps of:

- immersing the drum in a solvent selected from dibasic esters, aromatic solvents, acetone, and mixtures thereof (preferably dimethyl succinate or a mixture of dibasic esters comprising dimethyl succinate); and
- applying ultrasonic energy, for a period not to exceed about 30 minutes (preferably from about 5 to about 10 minutes), to said drum while it is immersed in the solvent.

The present invention also relates a method for selectively removing the charge transport layer from a photosensitive drum without damaging the charge generating layer on said drum, comprising the steps of

- immersing the drum in a solvent selected from dibasic esters, aromatic solvents, acetone, and mixtures thereof (preferably dimethyl succinate or mixtures of dibasic esters comprising dimethyl succinate), said solvent being substantially free of water; and
- applying ultrasonic energy to said drum while it is immersed in the solvent.

The aluminum drums which are recycled using the process of the present invention may have a charge transport layer recoated on them and then reused as photoconductors without further processing.

All percentages and ratios given herein are "by weight", unless otherwise specified.

DETAILED DESCRIPTION OF THE INVENTION

Photoconductors of the present invention find utility in electro-photographic reproduction devices, such as copiers and printers, and may be generally characterized as layered photoconductors wherein one layer (the charge generating layer—CGL) absorbs light and, as a result, generates an electrical charge carrier, while a second layer (the charge transport layer—CTL) transports the charge carrier to the exposed surfaces of the photoconductor.

These devices frequently have separate charge generating and charge transport layers with the charge transport layer being overlaid on the charge generating layer.

In the photoconductor structure, a substrate, which may be flexible (such as a flexible web or a belt) or inflexible (such as a drum), includes a thick layer of metallic aluminum. The aluminum layer functions as an electrical ground plane. In a preferred embodiment, the substrate is a roll and the aluminum is anodized which turns the aluminum surface into a thicker aluminum oxide surface (having a thickness of from about 2 to about 12$\mu$, preferably from about 4 to about 7$\mu$).

The aluminum layer is generally coated with a thin, uniform thickness charge generating layer comprising a photosensitive dye material dispersed in a binder.

Finally, the uniform thickness charge transport layer is coated onto the charge generating layer.

The thickness of the various layers in the photoconductor structure is important and is well known to those skilled in the art. In an exemplary photoconductor, the charge generating layer has a thickness of from about 0.05 to about 5.0$\mu$, preferably from about 0.1 to about 2.0$\mu$, most preferably from about 0.1 to about 0.5$\mu$; and the charge transport layer has a thickness of from about 10 to about 35$\mu$, preferably from about 25 to about 30$\mu$. If a barrier layer is used between the ground plane and the charge generating layers, typically it has a thickness of from about 0.5 to about 2.0$\mu$.

In forming the charge generating layer, a fine dispersion of a small particle photosensitive pigment material, such as phthalocyanine materials, is formed in the binder material, and this dispersion is coated onto the ground plane member. This is generally done by preparing the dispersion containing the photosensitive pigment and the binder and a solvent, coating the dispersion onto the ground plane member, and drying the coating.

Photosensitive pigments frequently used in photoconductors are phthalocyanine materials, which are well-known to those skilled in the art. Examples of such materials are taught in U.S. Pat. No. 3,816,118, Byrne, issued Jun. 11, 1974, incorporated herein by reference. Any suitable phthalocyanine may be used to prepare the charge generating layer portion of the photoconductor. The phthalocyanine used may be in any suitable crystalline form. It may be substituted or unsubstituted either (or both) in the six-membered aromatic rings and/or at the nitrogens of the five membered rings. Useful materials are described, and their syntheses given, in Moser & Thomas, *Phthalocyanine Compounds*, Reinhold Publishing Co. 1963, incorporated herein by reference. Particularly preferred phthalocyanine materials are those in which the metal central to the structure is titanium (i.e., titanyl phthalocyanines). Metal-free phthalocyanines are also particularly preferred, especially the X-crystalline form metal-free phthalocynanines. Such materials are disclosed in U.S. Pat. No. 3,357,989, Byrne, et al., issued Dec. 12, 1967; U.S. Pat. No. 3,816,118, Byrne, issued Jun. 11, 1974; and U.S. Pat. No. 5,204,200, Kobata, et al., issued Apr. 10, 1993, all of which are incorporated herein by reference. The X-type non-metal phthalocyanine is represented by the formula:

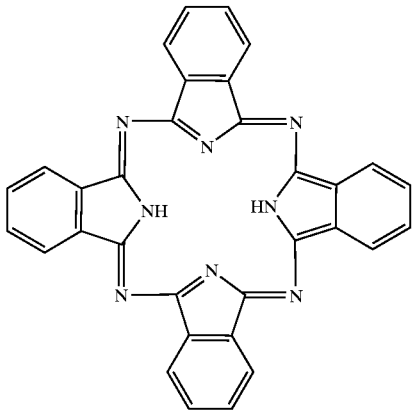

Such materials are commercially available in an electrophotographic grade of very high purity, for example, under the trade name Progen-XPC from Zeneca Colours Company, or under the name Type IV Oxo-Titanyl Phthalocyanine from Syntec.

As the binder, a high molecular weight polymer having hydrophobic properties and good film-forming properties for an electrically insulating film is preferably used. These high molecular weight film-forming polymers include, for example, the following materials, but are not limited thereto: polycarbonates, polyesters, methacrylic resins, acrylic resins, polyvinyl chlorides, polyvinylidene chlorides, polystyrenes, polyvinylbutyrals, ester-carbonate copolymers, polyvinyl acetates, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone alkyd resins, phenyl-formaldehyde resins, styrene-alkyd resins and poly-N-vinylcarbazoles. The binders can be used in the form of single resins or mixtures of two or more resins.

Specific examples of binder materials which may be used in the charge generating (and charge transport) layer include the bisphenol A and bisphenol A-bisphenol TMC copolymers described below, medium molecular weight polyvinyl chlorides (PVCs), polyvinylbutyrals, ester-carbonate copolymers, and mixtures thereof. The polyvinyl chloride compounds useful as binders have an average molecular weight (weight average) of from about 25,000 to about 300,000, preferably from about 50,000 to about 125,000, most preferably about 80,000. The PVC material may contain a variety of substituents including chlorine, oxirane, acrylonitrile or butyral, although the preferred material is unsubstituted. Polyvinyl chloride materials useful in the present invention are well-known to those skilled in the art. Examples of such materials are commercially available as GEON 110X426 from the GEON Company. Similar polyvinyl chlorides are also available from the Union Carbide Corporation.

Bisphenol-A, having the formula given below, is a useful binder herein:

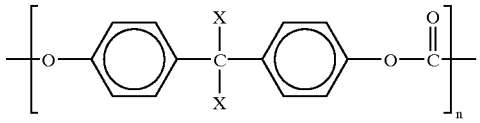

wherein each X is a $C_1$–$C_4$ alkyl and n is from about 20 to about 200.

Another type of bisphenol binder referred to above includes co-polymers of bisphenol A and bisphenol TMC. This copolymer has the following formula:

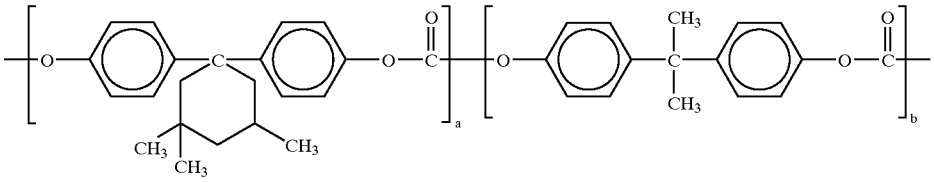

wherein a and b are selected such that the weight ratio of bisphenol A to bisphenol TMC is from about 30:70 to about 70:30, preferably from about 35:65 to about 65:35, most preferably from about 40:60 to about 60:40. The molecular weight (weight average) of the polymer is from about 10,000 to 100,000, preferably from about 20,000 to about 50,000, most preferably from about 30,000 to about 40,000.

Polyvinylbutyrals are the preferred binders for use in the charge generating layer.

In forming the charge generating layer, a mixture of the photosensitive pigment is formed in the binder material. The amount of photosensitive pigment used is that amount that is effective to provide the charge generating function in the photoconductor. This mixture generally contains from about 10 parts to about 65 parts, preferably from about 20 parts to about 50 parts, most preferably about 45 parts of the photosensitive pigment component, and from about 35 parts to about 90 parts, preferably from about 50 parts to about 80 parts, most preferably about 55 parts of the binder component.

The photosensitive pigment-binder mixture is then mixed with a solvent or dispersing medium for further processing. The solvent selected should:

(1) be a true solvent for high molecular weight polymers;

(2) be non-reactive with all components; and (3) have low toxicity.

Examples of dispersing media/solvents that may be used in forming the charge generating layer, used either alone or in combination with preferred solvents, include hydrocarbons, such as hexane, benzene, toluene, and xylene; halogenated hydrocarbons, such as methylene chloride, methylene bromide, 1,2-dichloroethane, 1,1,2-trichloroethane, 1,1,1-trichloroethane, 1,2-dichloropropane, chloroform, bromoform, and chlorobenzene; ketones, such as acetone, methylethyl ketone and cyclohexanone; ethers, such as ethyl acetate and butyl acetate; alcohols, such as methanol, ethanol, propanol, butanol, cyclohexanol, heptanol, ethylene glycol, methylcellosolve, ethylcellosolve, and derivatives thereof; ethers and acetals, such as tetrahydrofuran, 1,4-dioxane, furan and furfural; amines, such a pyridine, butylamine, diethylamine, ethylene diamine, isopropanolamine; nitrogen compounds, including amides, such as N,N-dimethylformamide; fatty acids and phenols; and sulfur and phosphorous compounds, such as carbon disulfide, and triethyl phosphate. The preferred solvents for use in the present invention are methyethyl ketone and cyclohexanone.

The mixtures formed include from about 1% to about 50%, preferably from about 2% to about 10%, most preferably about 5% of the photosensitive pigment/binder mixture, and from about 50% to about 99%, preferably from about 90% to about 98%, most preferably about 95%, of the solvent-dispersing medium. The entire mixture is then ground, using a conventional grinding mechanism, until the desired particle size is reached and the particles are dispersed in the mixture. The organic pigment may be pulverized into fine particles using, for example, a ball mill, homogenizer, paint shaker, sand mill, ultrasonic disperser, attritor or sand grinder. The preferred device is a sand mill grinder. The phthalocyanine photosensitive pigment has a particle size (after grinding) ranging from about 0.05$\mu$ to about 0.4$\mu$, with a particle size of from about 0.1$\mu$ to about 0.3$\mu$ being preferred. The mixture may then be "let down" or diluted with additional solvent to from about 2% to about 5% solids, providing the viscosity appropriate for coating, for example, by dip coating.

The charge generating layer is then coated onto the ground plane member. The dispersion from which the charge generating layer is formed is coated onto the ground plane member using methods well-known in the art, including dip coating, spray coating, blade coating, or roll coating, and is then dried. The preferred method for use is dip coating. The thickness of the charge generating layer formed should preferably be from about 0.1 to about 2.0$\mu$, most preferably about 0.5$\mu$. Once the ground plane member has been coated with the charge generating layer, it is allowed to dry for a period of from about 5 to about 100 minutes, preferably from about 5 to about 30 minutes, at a temperature of from about 25° C. to about 160° C., preferably from about 25° C. to about 100° C.

The charge transport layer is then prepared and coated onto the ground plane member so as to cover the charge generating layer. The charge transport layer is formed from a solution containing a charge transport molecule in a thermoplastic film forming binder. This solution is coated onto the charge generating layer and the coating is dried. Charge transport materials which may be used in electrophotographic photoconductors are well-known in the art and include, for example, amine materials, such as the aromatic amine compounds having the general formula:

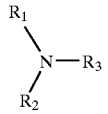

wherein $R_1$, $R_2$ and $R_3$ are aromatic groups independently selected from the group consisting of substituted or unsubstituted phenyl groups, naphthyl groups, and polyphenyl groups. $R_1$, $R_2$ and $R_3$ may represent the same or different substituents. The substituents should be free from electron-withdrawing groups such as $NO_2$ groups, CN groups and the like.

Examples of charge transport materials capable of supporting the injection of photogenerated holes from a charge generating layer and transporting the holes through the charge transport layer include bis(4-diethylamine-2-methyphenyl) phenylmethane; 4'4"-bis(diethylamino)-2',2"-dimethyltriphenylmethane; N,N'-bis(alkylphenyl)-[1,1'-diphenyl]-4,4'diamine, wherein the alkyl is, for example, methyl, ethyl, propyl, n-butyl, etc.; N,N'-diphenyl-N,N'-bis(chlorophenyl)-[1,1'-diphenyl]-4,4'-diamine; N,N'-diphenyl-N,N'-bis(3'-methylphenyl)-(1,1'-diphenyl)-4,4'-diamine, and the like. Particularly preferred charge transport materials include p-diethylaminobenzaldehyde diphenylhydrazone (DEH) and N,N'-bis-(3-methylphenyl)-N,N'-bis-phenylbenzidene (TPD).

The binders used in the charge transport layer of the present invention are the binders described above which are used in the charge generating layer. The preferred binders for use in the charge transport layer are the polycarbonates, such as the bisphenol A and bisphenol A-bisphenol TMC copolymers, previously described.

The mixture of charge transport molecule and binder is added to a solvent, such as those discussed above for use in forming the charge generation layer. Preferred solvents are THF, cyclohexanone, and methylene chloride. It is preferred that the solution contain from about 10% to about 40%, preferably about 20% of the binder/transport molecule mixture, and from about 60% to about 90%, preferably about 80% of the solvent. The charge transport layer is then coated onto the charge generating layer and the ground plane member (so as to cover the charge generating layer) using any of the conventional coating techniques discussed above. Dip coating is preferred. The thickness of the charge transport layer is generally from about 10 to about 35$\mu$, preferably from about 25 to about 30$\mu$. The percentage of solids in the solution, viscosity, the temperature of the solution, and withdrawal speed control the thickness of the transport layer. The layer is usually heat dried for about 30 to about 100 minutes, preferably from about 50 to about 90 minutes, at a temperature of from about 25° C. to about 160° C., preferably between about 75° C. and about 120° C. Once the transport layer is formed on the electrophotographic member, treatment of the layer by either using UV curing or thermal annealing is preferred in that it further reduces the rate of transport molecule leaching, especially at higher transport molecule concentrations.

In addition to the layers discussed above, an undercoating layer may be placed between the ground plane member (substrate) and the charge generating layer. This is essentially a primer layer that covers over any imperfections in the substrate layer, and improves the uniformity of the thin charge generation layer formed. Materials that may be used to form this undercoat include epoxy, polyamide, and polyurethane. It is also possible to place an overcoat layer (i.e., a surface protecting layer) on top of the transport layer. This protects the charge transport layer from wear and abrasion during the printing process. Materials which may be used to form this overcoat layer include polyurethane, phenolic, polyamide and epoxy resins. These structures are well-known to those skilled in the art.

As these photoconductor drums are utilized in the electrophotographic process, there tends to be wear on the outer layer of the roll, i.e., the charge transport layer. The process of the present invention allows this charge transport layer to be selectively stripped off the photoconductor without damaging or compromising in any way the charge generation layer. This selective stripping process is carried out in a quick, efficient and cost-effective manner. The recycled photoconductor drums may then have a new charge transport layer applied to them and they may then be utilized in electrophotographic processes, such as in copiers or printers. In the process of the present invention, the drum is immersed in a specially selected solvent and subjected to ultrasonic energy.

Solvents which may be used in the process of the present invention are those which dissolve the binder used in the charge transport layer, but not the binder used in the charge generating layer. For example, the solvents can solubilize the polycarbonate binders used in the charge transport layer but are not effective in dissolving the polyvinylbutyral (PVB) binders generally used in charge generating layers. Examples of such solvents include dibasic esters, such as dimethyl succinate, dimethyl glutarate, and mixtures of such esters. DBE, a mixture of dibasic esters commercially available from DuPont is a useful class of solvents for the selective stripping process. DBE-4, a mixture consisting primarily of dimethyl succinate, is a preferred solvent for the process in that it is non-hazardous, economical, available in large quantities and environmentally acceptable. Particularly preferred solvents include dimethyl succinate and mixtures of dibasic esters comprising dimethyl succinate. Ketones, such as acetone and methylethyl ketone, may also be used as solvents in the present invention. Finally, aromatic solvents, such as toluene and xylenes may be used as solvents in the present invention. Such aromatic solvents are particularly useful when used in combination with other solvents, such as hydrocarbon solvents. Thus, for example, a toluene/heptane mixture (weight ratio of from about 60/40 to about 95/5, preferably about 90/10) is useful in the present invention.

In contrast, the hydrocarbon solvents alone cannot be used in the present invention. Other well-known solvents also cannot be used in the present invention. For example, THF cannot be used since it is not selective and tends to remove all layers from the photoreceptor. Water also cannot be used since it does not effectively remove any layers from the photoconductor and also tends to dilute and therefore weaken any solvent used in admixture with it. In addition, water leaves an undesirable film on the surface of the photoconductor and also results in an undesirable waste water stream from the process. Thus, mixtures of solvents which include significant amounts of water are not suitable for use in the present invention. Therefore, preferred solvents used in the process of the present invention are substantially free of water (i.e., they contain no more than about 5%, preferably no more than about 1%, more preferably no more than about 0.5% water).

In order to be effective in an industrial setting, the process of the present invention must provide quick and selective removal of the charge transport layer, while leaving the charge generating layer in such an unaffected state that it can be resurfaced with a new charge transport layer and used without loss of performance. Unless the process functions quickly, it cannot be effectively used in an industrial setting. Therefore, the ultrasonic energy applied to the process of the present invention is generally applied for a period not to exceed about 30 minutes, preferably not to exceed about 15 minutes, and most preferably from about 5 to 10 minutes. The ultrasonic energy is generally applied for at least about 3 minutes and preferably at least about 5 minutes. A process which provides selective removal of the charge transport layer but takes a long time to do so (for example, from greater than about 30 to about 60 minutes or longer) is not useful in an industrial setting.

Ultrasonic energy is well-known in the art and may be applied from any device useful for providing ultrasonic energy to cleaning solutions. The energy is applied to the solvent solution containing the photosensitive drum for a period not to exceed about 30 minutes, preferably not to exceed about 15 minutes, more preferably not to exceed about 10 minutes, and most preferably from about 5 to about 10 minutes. The ultrasonic energy applied ranges from about 300 to about 500 watts/ft$^3$, preferably from about 375 to about 425 watts/ft$^3$. The frequency of the ultrasonic energy applied is from about 20 kHz to about 130 kHz, preferably from about 35 kHz to about 45 kHz. The process is carried out at a temperature of from about 25° C. to about 65° C., preferably from about 25° C. to about 35° C. Preferred solvents for use in the present invention include dibasic esters, such as dimethyl succinate and mixtures of dibasic esters comprising dimethyl succinate; acetone; toluene; xylene; and mixtures of toluene or xylene with aliphatic hydrocarbons, such as a 90/10 toluene/heptane mixture. The most preferred solvent is dimethyl succinate or mixtures of dibasic esters comprising dimethyl succinate.

After the selective layer removal process has been completed, the drum is dried by any conventional method, such as by oven drying. The drum may then be recoated with a new charge transport layer, using the procedures described above and may then be used in an electrophotographic process without any loss of performance.

The following examples illustrate the process of the present invention. The examples are intended to be illustrative only, and not limiting on the scope of the present invention.

EXAMPLE 1

This example demonstrates that the key electrical properties of a photoreceptor, such as sensitivity, residual voltage and dark decay, do not differ appreciably between the photoreceptors produced from selectively stripped and then recoated drums (using the process of the present invention) and control drums where the photoconductor has seen only one pass through the coating process.

In the first experiment, DBE-4 was used as the stripping solvent. Complete photoreceptors were removed from the end of the coating line and subjected to the selective CTL stripping process. The process was carried out as follows: photoconductors were immersed in a container of DBE-4 (DuPont) and the entire container then placed in an Aquasonic model 250T ultrasonic bath (Crest Ultrasonics Inc.) at 40 kHz and 72° F. Sonification was initiated and the DBE-4 bath was slowly stirred. The drums were removed from the sonification bath after 5 minutes. They were sprayed with acetone and then allowed to air dry These drums were then reinserted back into the coating line at the CTL coating step. The drums were again recovered at the end of the coating process along with sister control drums that had been through the process only once (i.e., had not been stripped and recoated). A parametric electrical evaluation of the drums was completed on an in-house electrostatic tester using an expose-to-develop time of either 61 or 101 milliseconds. Fatigue measurements were made by exposing the drums to 1,000 charge/discharge cycles. Table 1 demonstrates that the CTL-only stripped and recoated drums and the once-coated drums fall into the same population.

In a further experiment, photoreceptors that had been run to the end of their useful life in a printer and photoreceptors from the end of the coating process were collected and stripped with DBE-4 and then recoated (ultrasonic energy having a frequency of 40 kHz, and an energy of 400 watts/ft$^3$, was applied for 5 minutes). These drums were then evaluated electrically as described above and the results are presented in Table 2. Again, it can be seen that only minor differences exist after thick and thin drums are stripped, re-transported and compared.

defined above. Aliquots were removed from the bath over time and examined by UV-Visible Spectroscopy for traces of the intensely colored pigment present in the GCL. As Table 3 reveals, no pigment was detected during the time interval (less than 15 minutes) typically used in the stripping process. Only at much longer times (greater than 30 minutes) was there any evidence that the pigment was being disturbed.

In order to further evaluate these recycled drums, they were placed in a printer and run to cartridge life. Table 4 compares the electrical performance of the manufacturing standard to the recycled drum. Minimal differences are seen.

Table 5 details the print quality performance for these same two sets of drums during a printer test. Once again, minimal differences were seen.

All aspects relating to the electrical, print quality and toner usage performance over time were indistinguishable between the resurfaced photoconductors and the controls which have never been stripped and recoated, as evidenced by the data in the above tables.

TABLE 1

| Drum Description | Charge Voltage | V @ 0.00 uJ Cycles = 0 | V @ 0.19 uJ Cycles = 0 | V @ 1.00 uJ Cycles = 0 | DD @100 ms Cycles = 0 | DD @ 1 s Cycles = 0 |
|---|---|---|---|---|---|---|
| Initial Electricals @ 61 msec | | | | | | |
| DBE-4 Recycled | −858.37 | −847.57 | −308.85 | −94.23 | 4.4 | 42.1 |
| DBE-4 Recycled | −866.64 | −857.94 | −300.72 | −86.77 | 4.4 | 42.1 |
| Control | −865.63 | −859.74 | −323.75 | −91.23 | 4.7 | 43.4 |
| Control | −866.74 | −859.76 | −316.65 | −91.13 | 4.6 | 41.8 |

| Drum Description | V @ 0.00 uJ Cycles = 0 | V @ 0.19 uJ Cycles = 0 | V @ 1.00 uJ Cycles = 0 | DD @ 100 ms Cycles = 0 | DD @ 1 s Cycles = 0 |
|---|---|---|---|---|---|
| 1K Cycled Electricals @ 61 msec | | | | | |
| DBE-4 Recycled | −841.20 | −277.19 | −83.33 | 15.4 | 141.3 |
| DBE-4 Recycled | −851.68 | −274.97 | −80.23 | 13.5 | 122.7 |
| Control | −852.31 | −301.55 | −81.42 | 17.5 | 153.1 |
| Control | −851.58 | −303.38 | −79.18 | 17.5 | 152.1 |

TABLE 2

| Drum Description | Charge Voltage | V @ 0.00 uJ Cycles = 0 | V @ 0.26 uJ Cycles = 0 | V @ 1.30 uJ Cycles = 0 | DD @ 100 ms Cycles = 0 | DD @ 1 s Cycles = 0 |
|---|---|---|---|---|---|---|
| Initial Electricals @ 101 ms | | | | | | |
| Virgin Recycle | −884.51 | −847.87 | −107.55 | −48.19 | 6.9 | 61.3 |
| Life Test Recycle | −873.26 | −840.60 | −102.54 | −45.04 | 8.2 | 70.4 |
| Life Test Recycle | −884.51 | −850.70 | −100.75 | −46.34 | 5.4 | 47.1 |
| Virgin Recycle | −884.27 | −854.46 | −76.99 | −43.96 | 5.5 | 49.0 |
| Drum Description | Charge Voltage | V @ 0.00 uJ Cycles = 0 | V @ 0.26 uJ Cycles = 0 | V @ 1.29 uJ Cycles = 0 | DD @ 100 ms Cycles = 0 | DD @ 1 s Cycles = 0 |
| Initial Electricals @ 101 ms | | | | | | |
| Virgin Recycle | −884.51 | −835.51 | −103.49 | −47.16 | 14.5 | 126.3 |
| Life Test Recycle | −873.26 | −823.28 | −101.55 | −45.10 | 14.0 | 124.1 |
| Life Test Recycle | −884.51 | −833.87 | −108.42 | −47.08 | 15.5 | 134.9 |
| Virgin Recycle | −884.27 | −843.26 | −88.15 | −44.24 | 10.9 | 100.0 |

In order to examine more closely whether the CGL was being disturbed during the stripping process, optical densities were measured. A drum was subjected to the DBE-4/ultrasonic procedure (time=5 minutes; ultrasonic energy=400 watts/ft$^3$; ultrasonic frequency=40 kHz; temperature=72° F.), to remove the CTL from the drum. The DBE-4 bath was replaced with a fresh DBE-4 solution and the drum was reintroduced and further sonicated, using the protocol Finally, it should be noted that this recycling process may be repeated any number of times providing for even greater benefit. As Table 6 illustrates, drums were stripped and recoated five times using DBE-4. The electrical characteristics of the drums (N=3 average) were measured as described above at various stages during the process and compared to sister drums that had been coated for the first time. No significant differences were seen.

TABLE 3

| Time (min.) | Absorbance (688 nm) |
|---|---|
| 0 | 0 |
| 0.5 | 0 |
| 1 | 0 |
| 2 | 0 |
| 3 | 0 |
| 5 | 0 |
| 8 | 0 |

TABLE 3-continued

| Time (min.) | Absorbance (688 nm) |
|---|---|
| 15 | 0 |
| 30 | 0 |
| 60 | 0.014358 |
| 120 | 0.020893 |

TABLE 4

Photoconductor Electrical/Wear Data
Tests run in Optra T 616 Printers (35 ppm). Ambient Environment.
Slow run mode. 2.8% Text.

| Run | Pages | AB Dischg | | Isopel Dischg | | Charge Volts | | |
|---|---|---|---|---|---|---|---|---|
| Mode | Run | Init | EOL | Init | EOL | Init | EOL | PC Comments |
| Production Audits | | | | | | | | |
| Simplex | 30962 | 335 | 343 | 726 | 767 | 1144 | 1171 | Good surface wear |
| Simplex | 34959 | 360 | 377 | 739 | 784 | 1146 | 1174 | Fine scratches in paper area |
| Recoated Charge Transport Experimental PC Drums | | | | | | | | |
| Simplex | 34525 | 319 | 343 | 744 | 789 | 1147 | 1178 | Slight scratching in paper area |
| Duplex | 32339 | 319 | 328 | 746 | 783 | 1152 | 1176 | Good surface wear |

TABLE 5

Photoconductor Life Test Data
Tests run in Optra T 616 Printers (35 ppm). Ambient Environment.
Slow run mode. 2.8% Text.

| Run Mode | Pages Run | Toner Print | Avg Bkgd | 1200 DPI White-on-Black | Girl Black-on-White | Avg Iso OD | AB OD | PQ Comments |
|---|---|---|---|---|---|---|---|---|
| Production Audits | | | | | | | | |
| Simplex | 30962 | 15.2 | 0.48 | 10.2 | 125.0 | 0.34 | 1.40 | Good print quality |
| Simplex | 34959 | 14.1 | 0.77 | 9.0 | 125.0 | 0.30 | 1.39 | Good print quality |
| Recoated Charge Transport Experimental PC Drums | | | | | | | | |
| Simplex | 34525 | 14.4 | 2.1 | 8.8 | 125.0 | 0.48 | 1.39 | Good print quality at start of testing. Streaky graphics most of test |
| Duplex | 32339 | 14.8 | 2.6 | 10.4 | 124.0 | 0.65 | 1.41 | Good print quality |

TABLE 6

| Drum Description | Charge Voltage | V @ 0.00 uJ 61 ms | V @ 0.18 uJ | V @ 1.00 uJ | DD @ 100 ms | DD @ 1 s |
|---|---|---|---|---|---|---|
| ARTY Initials @ 61 ms | | | | | | |
| Control 0X | −851.29 | −849.30 | −426.10 | −70.21 | 3.26 | 28.28 |
| Recycled 0X | −851.84 | −849.67 | −428.35 | −73.47 | 3.05 | 27.00 |
| Control 1X | −858.79 | −854.11 | −388.06 | −62.53 | 3.55 | 31.46 |
| Recycled 1X | −861.15 | −854.55 | −411.93 | −72.25 | 2.92 | 24.58 |
| Control 3X | −854.88 | −849.46 | −406.81 | −63.31 | 4.16 | 37.46 |
| Recycled 3X | −853.35 | −849.01 | −403.96 | −73.51 | 3.19 | 28.78 |
| Control 5X | −854.42 | −848.51 | −399.89 | −73.36 | 3.21 | 27.48 |
| Recycled 5X | −852.13 | −847.99 | −390.01 | −84.17 | 2.97 | 26.06 |
| ARTY 1K @ 61 ms | | | | | | |
| Control 0X | −851.29 | −850.89 | −415.08 | −68.75 | 6.33 | 57.20 |
| Recycled 0X | −851.84 | −850.94 | −418.50 | −72.11 | 7.97 | 65.99 |

TABLE 6-continued

| Drum Description | Charge Voltage | V @ 0.00 uJ 61 ms | V @ 0.18 uJ | V @ 1.00 uJ | DD @ 100 ms | DD @ 1 s |
|---|---|---|---|---|---|---|
| Control 1X | −858.79 | −853.26 | −376.48 | −58.03 | 9.22 | 74.01 |
| Recycled 1X | −861.15 | −855.41 | −398.77 | −68.57 | 7.80 | 63.38 |
| Control 3X | −854.88 | −847.66 | −393.13 | −56.47 | 9.72 | 81.77 |
| Recycled 3X | −853.35 | −846.97 | −391.49 | −66.18 | 7.62 | 68.69 |
| Control 5X | −854.42 | −847.90 | −379.29 | −70.70 | 5.92 | 54.20 |
| Recycled 5X | −852.13 | −847.79 | −374.96 | −79.58 | 4.55 | 45.92 |

Some of the stripped and recoated drums were then placed back into a Lexmark Optra S printer and run to life again. All aspects relating to electrical, print quality and toner usage performance over time were indistinguishable from drums that had been coated only once as evidenced by the data in the preceding tables.

EXAMPLE 2

Photoconductor drums comprising an oxo-titanyl phthalocyanine CGL and a TPD polycarbonate-A CTL were exposed to the selective removal process for a total of 5 times, with testing after each time. These photoconductors were immersed in a container of DBE-4 (DuPont) and the entire container was then placed in an Aquasonic model 250T ultrasonic bath (Crest Ultrasonics Inc.) at 40 kHz and 72° F. Sonification was initiated and the DBE-4 bath was slowly stirred. The drums were removed from the sonification bath after 5 minutes. They were sprayed with acetone and then allowed to air dry. The stripped drums were inserted into a standard photoconductor coating line, before the charge transport layer coating step. The drums were collected at the end of the process and compared to drums exiting immediately before and after them (i.e. drums that had passed the entire coating process and had not been recoated). The electrical qualities of the two groups of drums were compared to each other statistically after steps 0, 1, 3, and 5. This process was done to the same stripped drums five times in order to determine how many times photoconductor drums can be stripped and then recoated. The electrical and print qualities of the two groups of drums were comparable to each other statistically.

What is claimed is:

1. A method for selectively removing the charge transport layer from a photosensitive drum without damaging the charge generation layer on said drum, comprising the steps of:

immersing the drum in a solvent selected from dibasic esters, aromatic solvents, acetone and mixtures thereof; and applying ultrasonic energy, for a period not to exceed about 30 minutes, to said drum while it is immersed in the solvent.

2. The method according to claim 1 wherein the ultrasonic energy is applied in a range of from about 300 to about 500 watts/ft$^3$.

3. The method according to claim 2 carried at a temperature of from 25° C. to about 65° C.

4. The method according to claim 3 wherein the ultrasonic energy is applied for no more than about 15 minutes.

5. The method according to claim 4 wherein the solvent comprises dibasic esters.

6. The method according to claim 5 wherein the solvent comprises dimethyl succinate.

7. The method according to claim 5 wherein the solvent is a mixture of dibasic esters comprising dimethyl succinate.

8. The method according to claim 5 wherein the ultrasonic energy is applied for from about 5 minutes to about 10 minutes.

9. The method according to claim 7 wherein the ultrasonic energy is applied for from about 5 minutes to about 10 minutes.

10. The method according to claim 4 wherein the solvent is selected from the group consisting of dimethyl succinate, acetone, toluene, xylene, and mixtures thereof.

11. The method according to claim 10 wherein the charge generating layer of said drum has a polyvinyl butyral binder and the charge transport layer of said drum has a polycarbonate binder.

12. The method according to claim 5 which comprises the additional step of re-applying a new charge transport layer to the treated photosensitive drum.

13. The method according to claim 2 when the ultrasonic energy applied has a frequency of from about 35 to about 45 kHz.

14. A method for selectively removing the charge transport layer from a photosensitive drum without damaging the charge generating layer on said drum, comprising the steps of:

immersing the drum in a solvent selected from dibasic esters, aromatic solvents, acetone, and mixtures thereof, said solvent being substantially free of water; and applying ultrasonic energy to said drum while it is immersed in the solvent.

15. The method according to claim 14 wherein the ultrasonic energy is applied in a range of from about 300 to about 500 watts/ft$^3$.

16. The method according to claim 15 wherein the ultrasonic energy applied has a frequency of from about 35 to about 45 kHz.

17. The method according to claim 16 carried out at a temperature of from about 25° C. to about 65° C.

18. The method according to claim 17 wherein the ultrasonic energy is applied for a period of no greater than about 30 minutes.

19. The method according to claim 18 wherein the ultrasonic energy is applied for a period of no greater than about 15 minutes.

20. The method according to claim 19 wherein the solvent comprises dibasic esters.

21. The method according to claim 20 wherein the solvent comprises dimethyl succinate.

22. The method according to claim 20 wherein the solvent is a mixture of dibasic esters comprising dimethyl succinate.

23. The method according to claim 20 wherein the ultrasonic energy is applied for from about 5 minutes to about 10 minutes.

24. The method according to claim 22 wherein the ultrasonic energy is applied for from about 5 minutes to about 10 minutes.

25. The method according to claim 19 wherein the solvent is selected from the group consisting of dimethyl succinate, acetone, toluene, xylene, and mixtures thereof.

26. The method according to claim 20 which comprises the additional step of re-applying a new charged transport layer to the treated photosensitive drum.

27. The method according to claim 25 wherein the charge generating layer of said drum has a polyvinylbutyral binder and the charge transport layer has a polycarbonate binder.

* * * * *